US010774555B2

(12) United States Patent
Baker

(10) Patent No.: US 10,774,555 B2
(45) Date of Patent: Sep. 15, 2020

(54) POOL GUTTER AND AIR EVACUATOR ASSEMBLY

(71) Applicant: Paddock Pool Equipment Company, Inc., Rock Hill, SC (US)

(72) Inventor: Donald Cyrus Baker, Clover, SC (US)

(73) Assignee: Paddock Pool Equipment Company, Inc., Rock Hill, SC (US)

( * ) Notice: Subject to any disclaimer, the term of this patent is extended or adjusted under 35 U.S.C. 154(b) by 0 days.

(21) Appl. No.: 16/219,157

(22) Filed: Dec. 13, 2018

(65) Prior Publication Data

US 2019/0316372 A1 Oct. 17, 2019

Related U.S. Application Data

(60) Provisional application No. 62/598,027, filed on Dec. 13, 2017.

(51) Int. Cl.
*E04H 4/12* (2006.01)

(52) U.S. Cl.
CPC ..... *E04H 4/1227* (2013.01)

(58) Field of Classification Search
CPC ..... E04H 4/1227
USPC ..... 4/510
See application file for complete search history.

(56) References Cited

U.S. PATENT DOCUMENTS 3,057,287 A 10/1962 Gray
3,492,761 A 2/1970 Taylor
3,668,714 A 6/1972 Baker
3,835,606 A 9/1974 Liberman
3,844,338 A 10/1974 Hilgemann et al.
3,940,807 A 3/1976 Baker
3,975,780 A 8/1976 Bowen et al.
4,050,104 A 9/1977 Baker
4,080,670 A 3/1978 Van den Broek
4,127,485 A 11/1978 Baker
4,133,058 A 1/1979 Baker
4,133,059 A 1/1979 Baker
4,146,937 A 4/1979 Baker
4,206,522 A 6/1980 Baker
4,389,739 A 6/1983 Baker
4,419,233 A 12/1983 Baker
4,462,125 A 7/1984 Jakowicki
4,542,544 A 9/1985 Baker
4,593,421 A 6/1986 Cohen
4,627,118 A 12/1986 Baker
(Continued)

FOREIGN PATENT DOCUMENTS

CA 2742065 C 2/2018

*Primary Examiner* — Christine J Skubinna
(74) *Attorney, Agent, or Firm* — Greer, Burns & Crain, Ltd.

(57) ABSTRACT

A pool perimeter assembly includes conduits extending between the sidewalls, wherein the conduits are separated by a common wall between the sidewalls. A grate is positioned on the gutter apparatus to direct fluid flow into at least one of the conduits. The fluid flow may include water or air. A first length of the perimeter assembly includes conduits defining a gutter trough and an extra gutter, and the common wall defines a common opening between the conduits. A second length of the assembly includes two conduits defining a gutter trough conduit and an air evacuator conduit separated by a section of the common wall without the common opening. The evacuator conduit is connected to an air exhaust system to remove water vapor and contaminated air from the area surrounding the pool.

12 Claims, 15 Drawing Sheets

(56) References Cited

U.S. PATENT DOCUMENTS

| | | | |
|---|---|---|---|
| 4,758,292 | A | 7/1988 | Baker |
| 4,876,949 | A | 10/1989 | Fairchild |
| 4,997,558 | A | 3/1991 | Baker |
| 5,220,698 | A | 6/1993 | Hannant |
| 5,425,145 | A | 6/1995 | Baker |
| 5,621,956 | A | 4/1997 | Kolesar |
| 5,686,696 | A | 11/1997 | Baker |
| 5,701,615 | A | 12/1997 | Baker |
| 5,930,850 | A | 8/1999 | Baker |
| 5,978,979 | A | 11/1999 | Baker |
| 6,023,793 | A | 2/2000 | Baker |
| 6,729,795 | B2 | 5/2004 | Dahowski et al. |
| D515,183 | S | 2/2006 | Nigro et al. |
| 7,137,155 | B2 | 11/2006 | Sugranes |
| 9,540,836 | B2 | 1/2017 | Baker |
| 9,631,387 | B2 | 4/2017 | Baker |
| 10,072,868 | B2 | 9/2018 | Baker |
| 2009/0139019 | A1 | 6/2009 | Shebek et al. |
| 2009/0183453 | A1 | 7/2009 | Koessler et al. |
| 2009/0233540 | A1 | 9/2009 | Valentino |
| 2010/0050335 | A1 | 3/2010 | Baker |
| 2010/0258206 | A1 | 10/2010 | Baker |
| 2011/0244782 | A1 | 10/2011 | Baker |
| 2014/0117102 | A1 | 5/2014 | Baker |

POOL GUTTER AND AIR EVACUATOR ASSEMBLY

CROSS REFERENCE TO RELATED APPLICATIONS

This Application is a non-provisional of and claims priority to U.S. Provisional Patent Application Ser. No. 62/598,027 filed on Dec. 13, 2017, the entirety of which is incorporated by reference herein.

FIELD OF THE DISCLOSURE

This disclosure relates to devices installed around a pool perimeter including gutter assemblies directing water from the pool to a filtration system and evacuation assemblies directing contaminated air from the surface of the pool and into an exhaust system.

BACKGROUND

The chemicals used to treat water in a swimming pool create contaminants that may be harmful to swimmers and others present within an enclosure housing a swimming pool (e.g., a natatorium). The water in the swimming pool also creates water vapor (i.e., humidity) within the swimming pool facility. The contaminants (e.g., chloramine) can irritate the eyes and air passages of individuals in and around the pool area. The contaminants such as chloramine are present in the air within the swimming pool enclosure, but are concentrated in an area immediately above the surface of the swimming pool. Unfortunately, greater amounts of chloramine are created when the swimming pool is in use due to swimmers agitating the water (e.g., swimming and splashing). Moreover, the high humidity within the enclosure creates an uncomfortable environment for individuals and can affect the physical structure (e.g., girders and roofing) forming the enclosure (e.g., corrosion).

Moreover, the high humidity formed within the enclosure housing a swimming pool requires that a heating, ventilating, and air conditioning (HVAC) system run almost continuously to circulate and dehumidify the air contained within the enclosure. In addition, the HVAC system runs nearly continuously to circulate the air in order to avoid high concentrations of contaminants in the air.

Prior art FIGS. 1-3 illustrate previously disclosed deck drain gutter assemblies (20) for installing along a pool perimeter (10). The gutter assemblies include conduits formed by sidewalls (16A, 16B), lower wall (15), and grate (21). One of the conduits is a filtered pool water return tube (11) that replenishes the pool in an ongoing filtration system, and another conduit may be a contaminated air removal conduit, designated in FIG. 1 as a perimeter plenum (12) that transports air to a contaminated air removal exhaust system (13), as shown in FIGS. 2-3. Each perimeter plenum (12) defines an evacuator port (22) through which contaminated air proximate the pool, especially above the surface of the pool, is forced toward the perimeter plenum for transport by the exhaust system (13) to an outside area or an air filtration system.

An HVAC system directs air pressure onto and/or across a surface of the pool to force the above noted contaminated air into one or more of the evacuator ports (22). FIG. 2 illustrates that the perimeter assembly incorporating the perimeter plenum (12) and evacuator ports (22) may evacuate air from areas all the way around the pool perimeter, such as when an HVAC system directs air pressure from the top down, and the exhaust system (13) draws contaminated air into the evacuator ports (22). FIG. 3 illustrates that the HVAC system may incorporate air duct configurations that direct air pressure from only one, or any number less than all, of the number of sides of the pool and push the air into evacuator ports (22) installed on other sides of the pool perimeter plenum.

It is desirable therefore to reduce the levels of contaminants and humidity within the enclosure housing a swimming pool. Moreover, it is desirable for swimming pool facilities to improve the efficiency of the HVAC system in order to reduce costs associated with circulating, filtering, and dehumidifying the air within the swimming pool facility.

Accordingly, the present invention addresses the requirements for an energy-efficient apparatus and method for evacuating contaminants and water vapor from a swimming pool facility.

BRIEF SUMMARY OF THE DISCLOSURE

In a first embodiment a pool perimeter assembly includes conduits extending between sidewalls, wherein the conduits are separated by a common wall between the sidewalls. A grate is positioned on the gutter apparatus to direct fluid flow into at least one of the conduits. The fluid flow may include water or air. A first length of the perimeter assembly includes conduits defining a gutter trough and an extra gutter, and the common wall defines a common opening between the conduits. A second length of the assembly includes two conduits defining a gutter trough conduit and an air evacuator conduit separated by a section of the common wall without the common opening. The evacuator conduit is connected to an air exhaust system to remove water vapor and contaminated air from the area surrounding the pool.

Another embodiment shows the assembly for use as a section of a pool perimeter and includes a pool perimeter apparatus defining at least two conduits extending between a first sidewall and a second sidewall, wherein the conduits are separated by a common wall between the first sidewall and the second sidewall. A grate is positioned on the gutter apparatus in a position to direct fluid flow into at least one of the conduits, and the grate defines a hand hold section that drains into one of the conduits.

In yet another embodiment, an apparatus directs air including water vapor and contaminants to an exhaust conduit from an area above a pool enclosing a body of liquid, wherein the pool is adjacent to and surrounded by a grating system that is positioned between a deck and the pool. The apparatus includes a first sidewall and an opposite second sidewall both connected to a bottom wall to define a pool perimeter assembly collecting and directing fluid flow received from the body of liquid through the grating system. In this embodiment, the first sidewall is connected to the pool. A common wall is positioned between the first sidewall and the second sidewall such that the first, second, and common side walls define first and second conduits extending between the first sidewall and the second sidewall. One of the conduits directs air in a fluid flow to an exhaust system, wherein the air includes water vapor and contaminants. The conduit directing air is in a position that avoids collecting liquids received through the grating system. The conduits define respective ports between the pool and the deck.

A system embodiment manages fluid flow through a pool perimeter assembly and directs ambient air flow from an air handling source across the surface of a pool of liquid and moves pool surface air flow. The system evacuates the pool surface air flow into at least one port defined by the pool perimeter assembly conduit and into an exhaust system. To position the at least one port to move the pool surface air into an evacuation conduit, the evacuation conduit is integrated into a gutter apparatus defining at least two conduits extending between a first sidewall and a second sidewall, wherein the conduits are separated by a common wall between the first sidewall and the second sidewall. A first length of the perimeter assembly includes the two conduits defining a gutter trough conduit and an extra gutter conduit separated in part by the common wall, wherein the common wall defines a common opening between the gutter trough conduit and the extra gutter conduit. A second length of the assembly includes the two conduits defining a gutter trough conduit and an evacuator conduit separated by a section of the common wall without the common opening.

DETAILED DESCRIPTION

Figure 4:
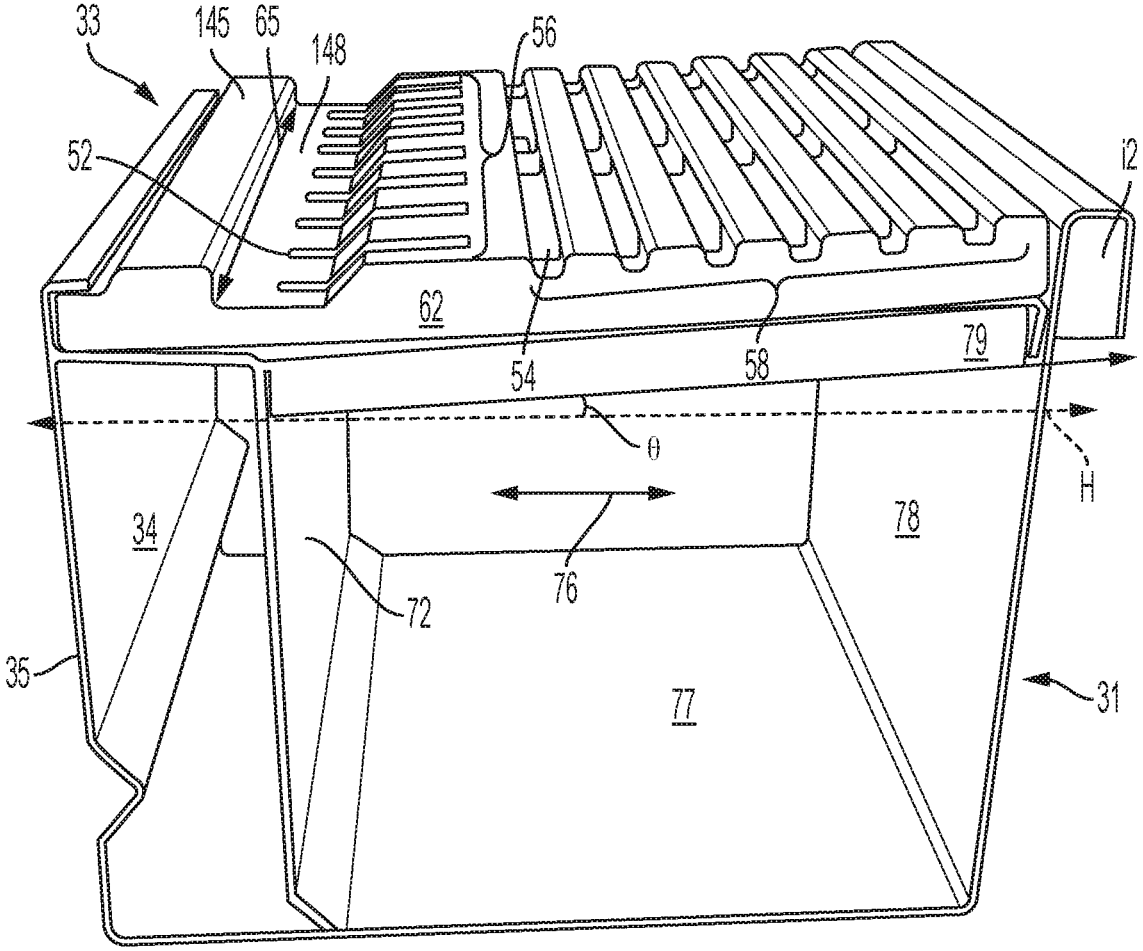
FIG. 4 is a side elevation view of a gutter apparatus having a grate thereon and connected to a pool water return conduit as disclosed herein.
Figure 7:
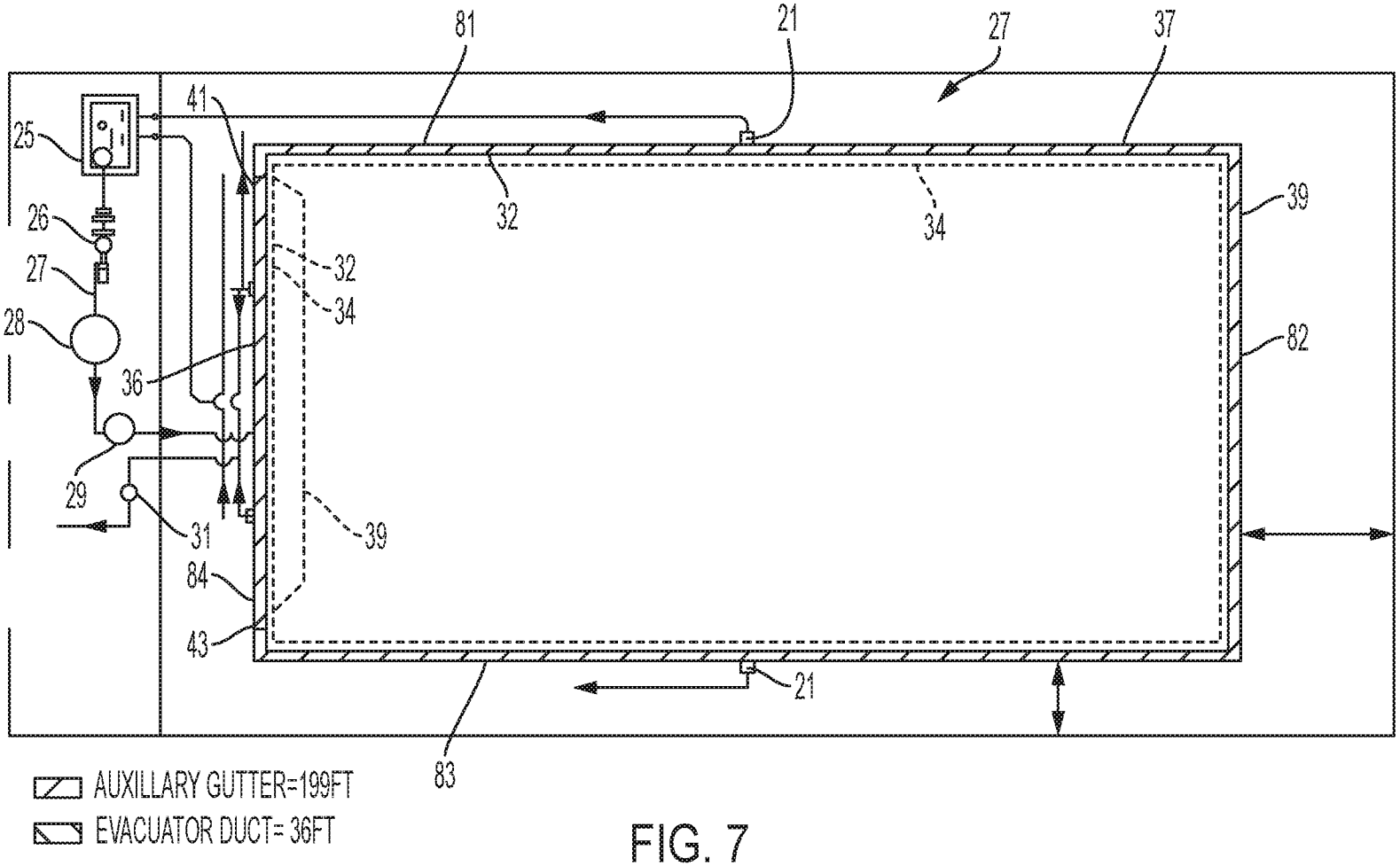
FIG. 7 is a top plan view of a pool incorporating the assembly of FIG. 5 around a pool perimeter as disclosed herein.

One embodiment of this disclosure, which is not limiting of the embodiments but merely shown for example, is a pool perimeter assembly (FIG. 7, Ref. (27)) that could be configured to incorporate the deck drain apparatus (33) of FIG. 4. In FIG. 4, the deck drain apparatus (33) is shown as incorporating two conduits—a filtered water return conduit (34) and a deck drain gutter conduit (76) into which backsplash from the pool and/or excess water collecting on a deck surrounding the pool enters through a grate (62). The grate (62) defines drain ports (52) aligned about the grate surface in a series (56), and optionally, another series (58) of different grate ports (54) that may be oriented in a different direction. In the example embodiment of FIG. 4, the distinct series (56, 58) of grate ports (52, 54) are perpendicular to one another, but other respective directions are equally available for manufacture. The grate (62) of FIG. 4 is characterized in part by defining a hand-hold section (65) that defines a convenient grip for a person's hand when that person is in the pool and proximate the perimeter assembly. The hand hold section may be divided into components including the grip (145) rising above a recess (148). The hand-hold section (65) is further configured for installation with the hand-hold section defining one of the above described series (56) of ports (52) that drain into the deck drain gutter conduit (76) (i.e., the ports (52) within the grate that are closest to the hand-hold section (65) and direct back-splashed liquid from the pool out of the hand-hold section (65), through the ports (52), and into the deck drain gutter conduit (76)). The remaining ports (54) in the grate (62) direct water that is splashed out of and/or beyond the hand-hold section (65) from the pool into the deck drain gutter conduit (76). The return conduit (34) has a construction configured for installation proximate the pool and between the deck drain gutter conduit (76) and the pool. The deck drain gutter conduit (76) may have a variety of shapes and designs as needed for the installation at hand, but FIG. 4 illustrates one of such configurations in which the deck drain gutter conduit (76) is defined by sidewalls (72, 78) connected by a horizontal base (77). A support structure (79) may also connect the sidewalls on respective ends opposite the base (77). The support structure (79) is positioned to support the grate (62) without interfering with the ports (52, 54) opening into the deck drain gutter conduit (76).

FIG. 4 illustrates another feature of the deck drain apparatus (33) that aids in more efficient water removal areas around a pool of liquid, such as a deck area around a swimming pool. In one example embodiment, that does not limit the scope of installations relevant to this disclosure, the deck drain assembly (33) has a construction in which the outermost wall (35) of the return conduit (34), relative to the overall assembly (33), is configured such that the grate (62) rests on the assembly (33) in a position that includes an angle of incline (theta) relative to a horizontal (H) extending from a pool edge. In other words, in one installation, a pool having a pool side structure (i.e., pool wall (FIG. 1, Ref. 3)) enclosing a body of liquid, supports an adjacent filtered water return conduit (34) having an outermost wall (35) proximate the pool side structure. The pool side structure typically includes a top edge defining at least one horizontal (H) axis for purposes of a point of reference herein only. In the embodiment of FIG. 4, the grate (62) rests on the deck drain apparatus (33) such that the grate (62) is elevated along a surface (31) opposite the water return conduit (34). Such assembly provides additional back splash capacity without restricting use of an associated deck. In one non-limiting embodiment, there is a one-inch difference in elevation, relative to horizontal (H) from the pool side (i.e., the outer most side (35) of the filtered water return conduit (34)) to an opposite side wall (78) or outer surface (31) of the side wall particularly in regard to the base (77).

Figure 5:
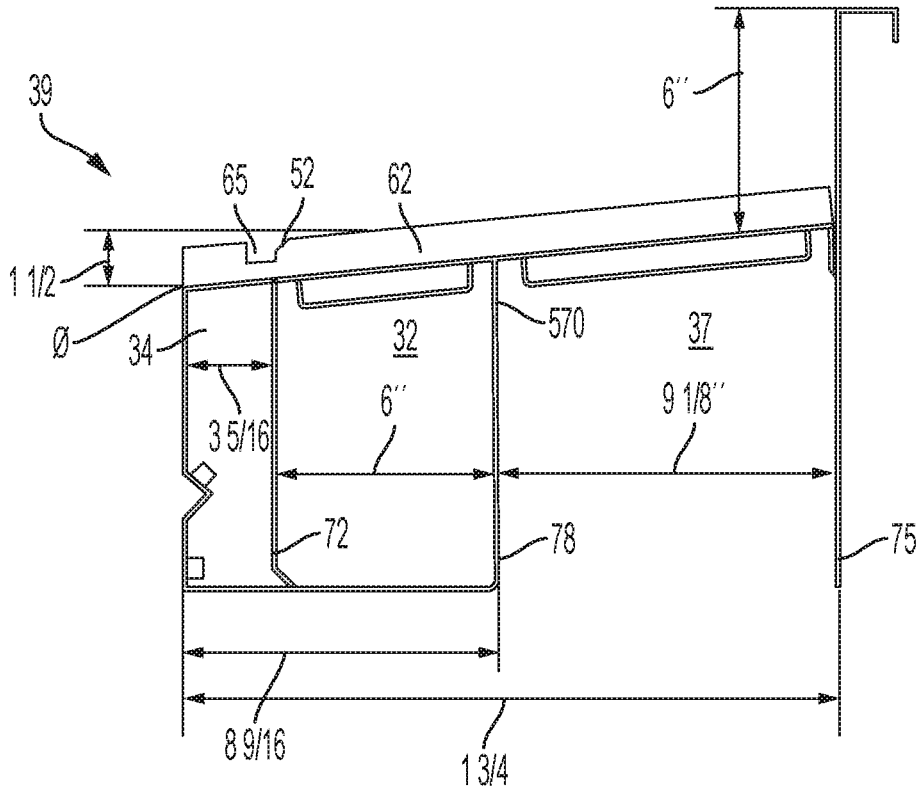
FIG. 5 is a side cross section view of a pool perimeter assembly having a return conduit and two conduits for use with a pool perimeter construction as disclosed herein.

FIG. 5 illustrates yet another embodiment that includes another construction for a multi-conduit deck drain apparatus (39). Similar to the embodiment of FIG. 4, the multi-conduit construction incorporates the filtered water return conduit (34) configured for installation alongside a pool side structure enclosing a body of liquid, such as a pool wall (FIG. 1. Ref 3). Instead of a single deck drain gutter conduit (76) described above, the embodiment of FIG. 5 incorporates a multi-conduit construction (32, 34, 37) that includes the return conduit (34), a gutter trough conduit (32), and an extra gutter trough conduit (37). The extra gutter trough conduit (37) has a dual purpose, depending on its position relative to an associated pool of water, as discussed below. In the embodiment of FIG. 5, the extra gutter trough conduit (37) is adjacent the gutter trough conduit (32) such that the gutter trough conduit (32) is between the extra gutter trough conduit (37) and the filtered water return conduit (34). In this position the extra gutter trough conduit (37) is available for additional water removal from back splash water from a pool or from water accumulating on the deck. In extreme instances, the gutter trough conduit (32) may fill to capacity during times of heavy use of the pool, such as when a swimming pool is full of swimmers and at capacity. In this scenario, when the gutter trough conduit (32) fills to a predefined limit, an overflow port (57) is available to allow drainage into the extra gutter trough conduit (32). In the embodiment of FIG. 5, the grate (52) extends over all of the conduits in the deck drain assembly (39), and includes the ports as described for FIG. 4.

Figure 1:
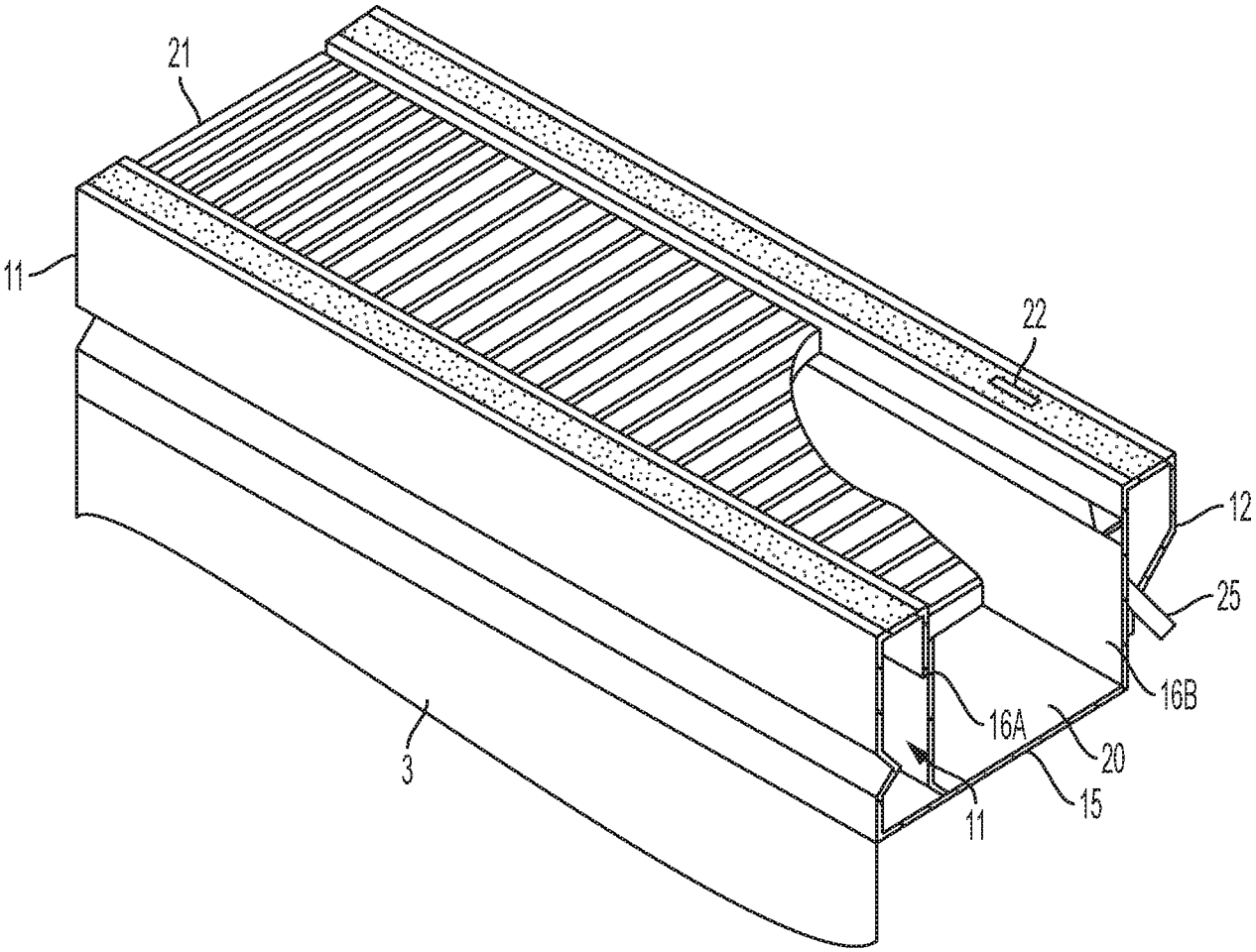
FIG. 1 PRIOR ART
FIG. 1 is a PRIOR ART perspective view of a gutter and perimeter plenum assembly for installation around a pool.
Figure 2:
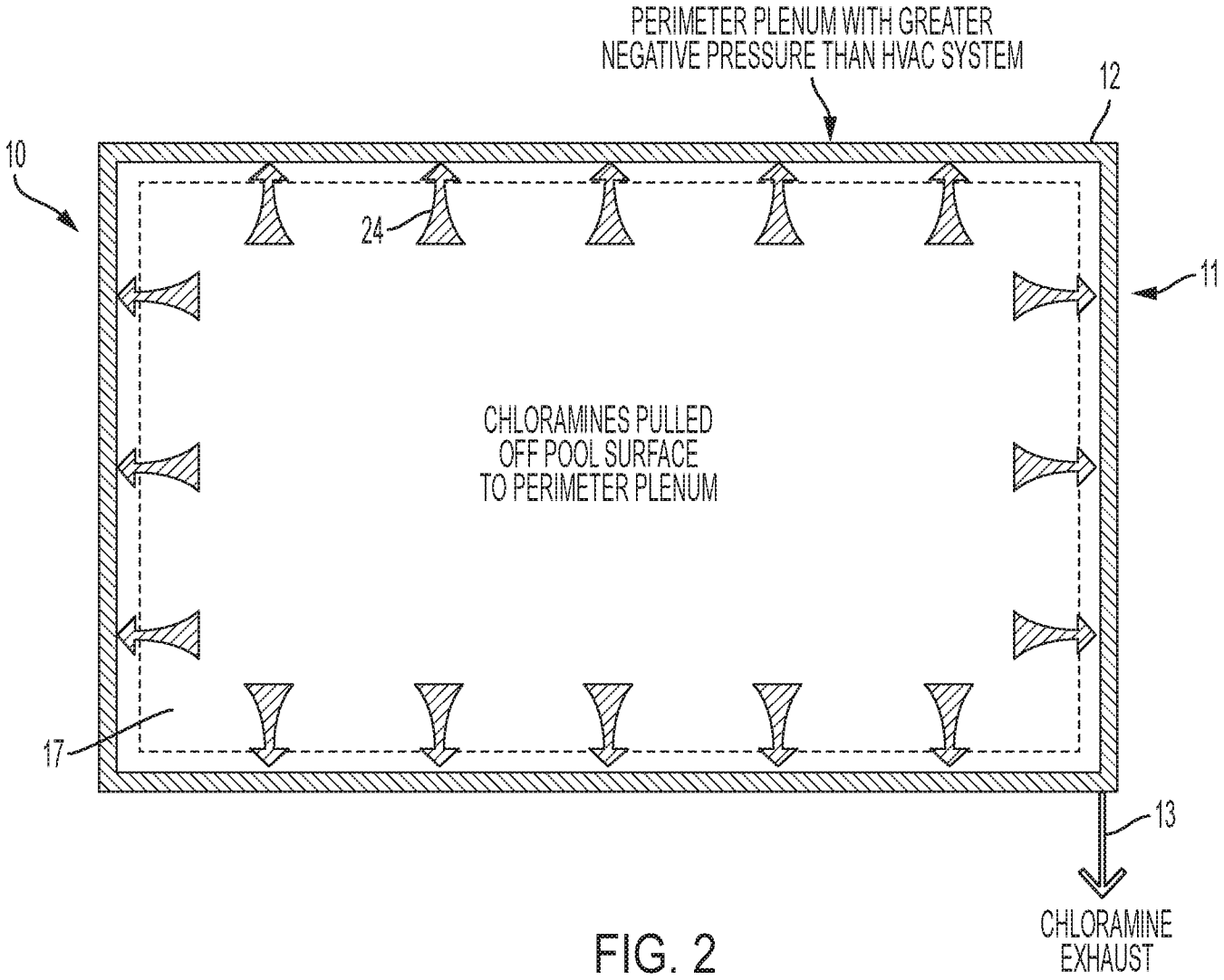
FIG. 2 PRIOR ART
FIG. 2 is a PRIOR ART plan view of a pool having a perimeter construction using the gutter and perimeter plenum assembly of FIG. 1.
Figure 3:
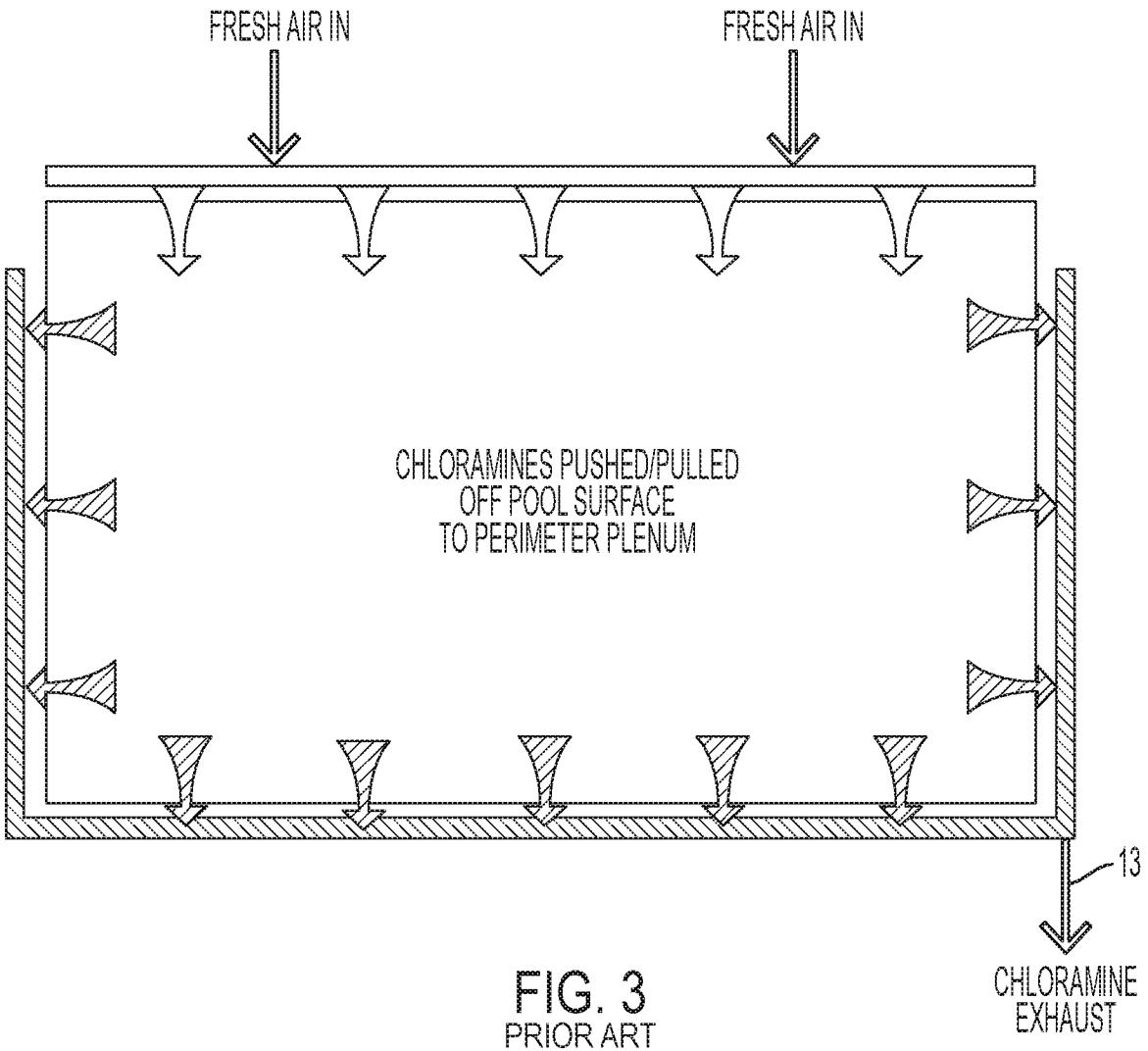
FIG. 3 PRIOR ART
FIG. 3 is a PRIOR ART plan view of a pool having a perimeter construction using the gutter and perimeter plenum assembly of FIG. 1 on less than all sides of the pool.

In terms of construction, the filtered water return conduit (34) may have a structure similar to that described above with an outermost wall (35) connected or directly proximate a side structure of a pool (i.e., the pool wall (FIG. 1, Ref. 3). The deck drain gutter trough conduit (32) is between the return conduit (34) and an extra gutter trough conduit (37). Respective sidewalls define the conduits, and these sidewalls may include commonly shared wall structures or separate wall structures that are merely close together or connected together at select points. In one embodiment, shown in FIG. 5, a common wall (78) separates a first sidewall (72) and second sidewall (75) of the overall deck drain assembly (39). The angle of inclination (theta) is also depicted in FIG. 5 from left to right (defining an incline of a measured amount, e.g., a three fourths inch elevation from a pool side structure to an outermost wall (75)).

Figure 6:
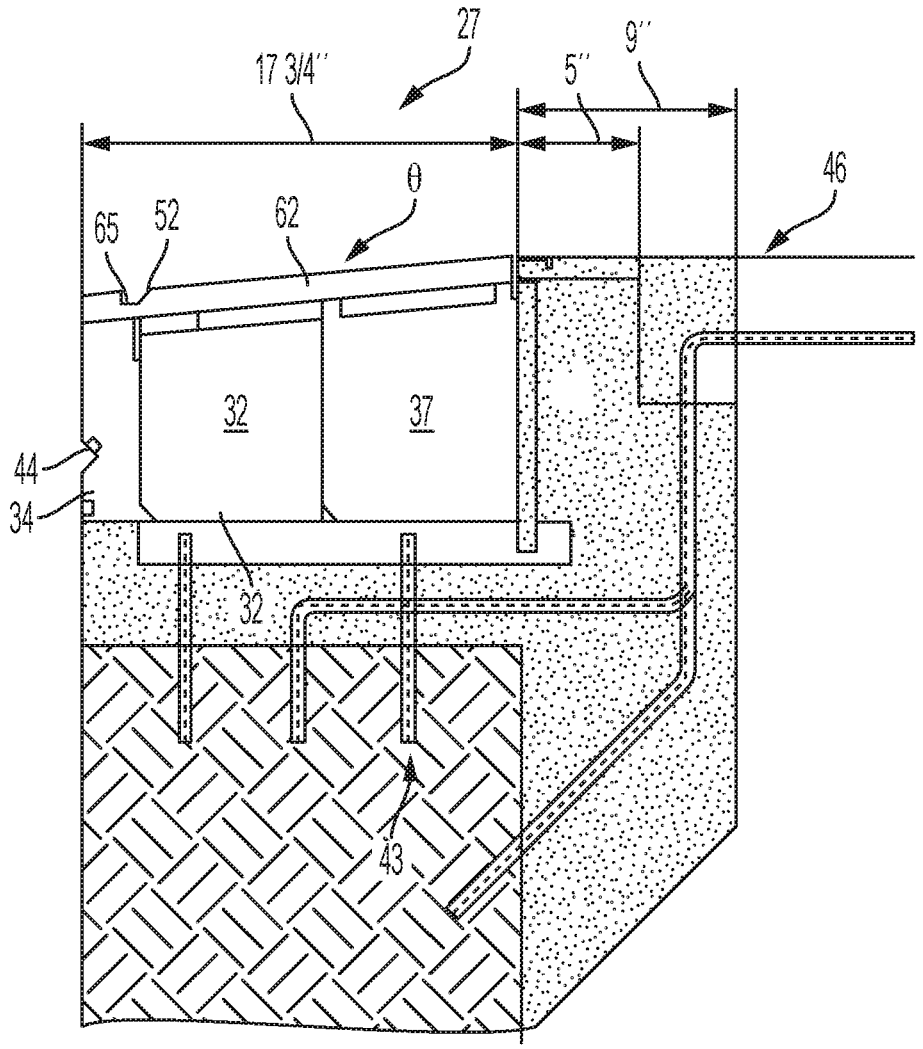
FIG. 6 is a side cross section view of a pool perimeter installed on a foundation around a pool wall and including the assembly of FIG. 5 as disclosed herein.

FIG. 6 illustrates the concepts described above and shows the foundational structures that may be used in constructing an area around a perimeter of a pool as described herein. FIG. 6 incorporates the foundational anchors (43) that support a pool perimeter assembly (27) installed about a pool surrounding a body of liquid and positioned between a pool wall (41) and a deck (46) surrounding the pool. Liquids such as water in a swimming pool splash beyond the pool wall and into a deck drain gutter assembly (39) through the above described ports (52, 54) that are present but not directly pointed out in FIG. 6. FIG. 6 also illustrates an example arrangement of a finished pool wall (41) extending from foundational structures and identifying normal water level (47) relative to a grate (62) having a hand hold (65) that drains into the gutter trough conduit (32). In the illustration of FIG. 6, the angle of inclination is denoted as Beta relative to elevation 0-0 defined by the surface of the deck (46). Other functional characteristics of the assembly of FIG. 6 include the water return outlet (44).

FIG. 7 illustrates yet another use for the multi-conduit deck drain gutter assembly (39) that may be installed as at least a portion of a pool perimeter assembly (27). The pool perimeter assembly of FIG. 7 illustrates how the multi-conduit assembly (39) of FIGS. 5-6 may be used for disparate purposes along respective sections of a pool perimeter. In FIG. 7, three of four sides (81, 82, 83) of a pool perimeter are shown, for example only and without limiting the disclosure, as using the above described extra gutter trough (37) for water overflow as shown in FIG. 5. In this embodiment, the overflow port (57) of FIG. 5 defines an outlet from the gutter trough conduit (32) to the extra gutter trough conduit (37) so that overflow liquids, such as back-splashed pool water, have another water conduit to exit the pool area and the deck as necessary. In FIG. 7, the multi-conduit gutter assembly includes three exemplary conduits—the filtered water return tube (34), the gutter trench conduit (32), and the extra gutter trench conduit (37)—around three of four sides (81, 82, 83) of a pool. The gutter trench conduit (32) and the extra gutter trench conduit (37) direct water out of the pool installation via perimeter overflow outlets (21). These perimeter overflow outlets (21) direct back-splashed water from the pool and collected water from the deck (46) into a water removal system with components such as a surge tank (25), a strainer (26), a pump, filters (28), filtered water return lines (29), etc. that collectively meet regulatory requirements for clean liquids/water in the pool.

Figure 8:
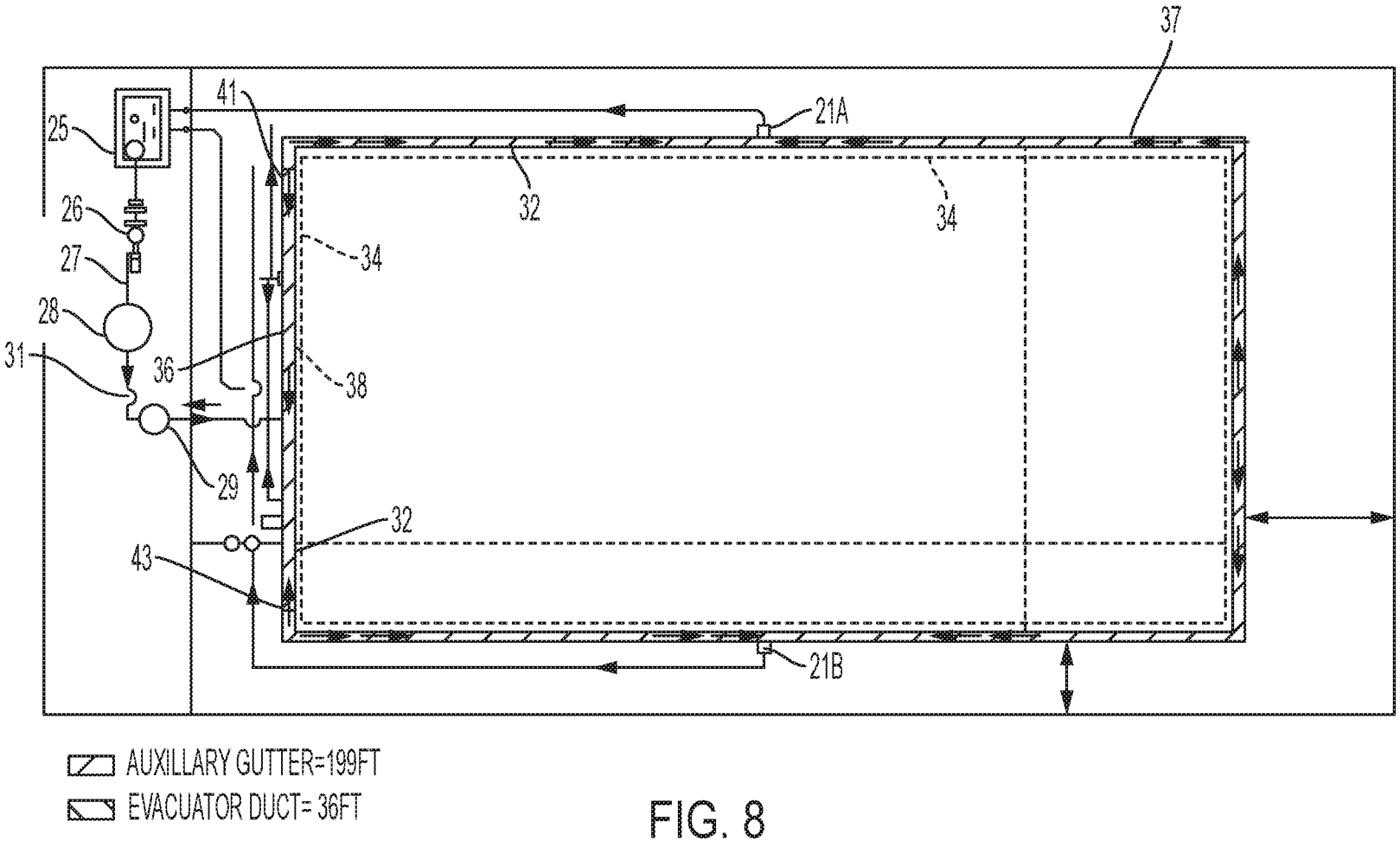
FIG. 8 is a top plan view according to FIG. 7 and incorporating fluid flow directions about a pool perimeter as disclosed herein.

FIG. 7 further illustrates that a fourth side (84) of the pool may utilize the extra gutter trough conduit, previously designated a water overflow route (37), as an air evacuation route (38). In other words, the physical structure of the perimeter assembly (27) and/or the multi-conduit deck drain gutter assembly (39) of FIGS. 5-6 includes the extra gutter trough conduit (37) that can be used as an air evacuator conduit (38) along a designated section of a pool perimeter. The air removal section (42) of a pool perimeter may utilize the multi-conduit deck drain gutter assembly in a different way than the water overflow sections of the pool perimeter described herein. Accordingly, for purposes of this disclosure, when the extra gutter trough conduit is utilized for air evacuation, this disclosure refers to that section of the overall deck-drain gutter assembly (39) as an evacuator conduit (38). As shown in FIG. 7, bulk head stops (41, 43) separate and stop water flow in the extra gutter conduit (37); accordingly, the overall deck drain gutter assembly (39), with multiple conduits (34, 32, 38), includes a return water conduit (34), a gutter trough conduit (32), and an air evacuator conduit (38). The air evacuator conduit (38) may include a contaminated air port through which chloramines and other air flow proximate the surface of a pool are directed to an exhaust system (95). As described above, HVAC systems may be configured to push air from the surface of the pool into the evacuator conduit (38) and into the exhaust system (95). FIG. 8 illustrates how the system of FIG. 7 may direct air flow into the exhaust system of FIG. 7 and simultaneously direct excess water flow into the perimeter overflow dropouts (21).

Figure 9:
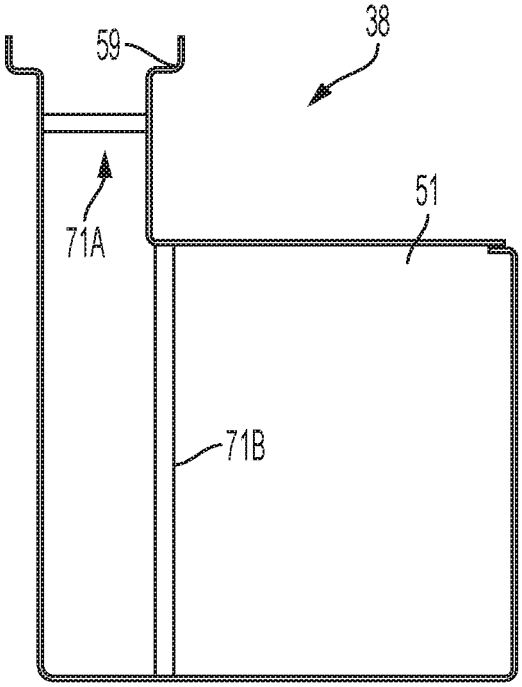
FIG. 9 is a cross section view of an air evacuation conduit for use with a gutter apparatus to form a pool perimeter assembly as disclosed herein.
Figure 13:
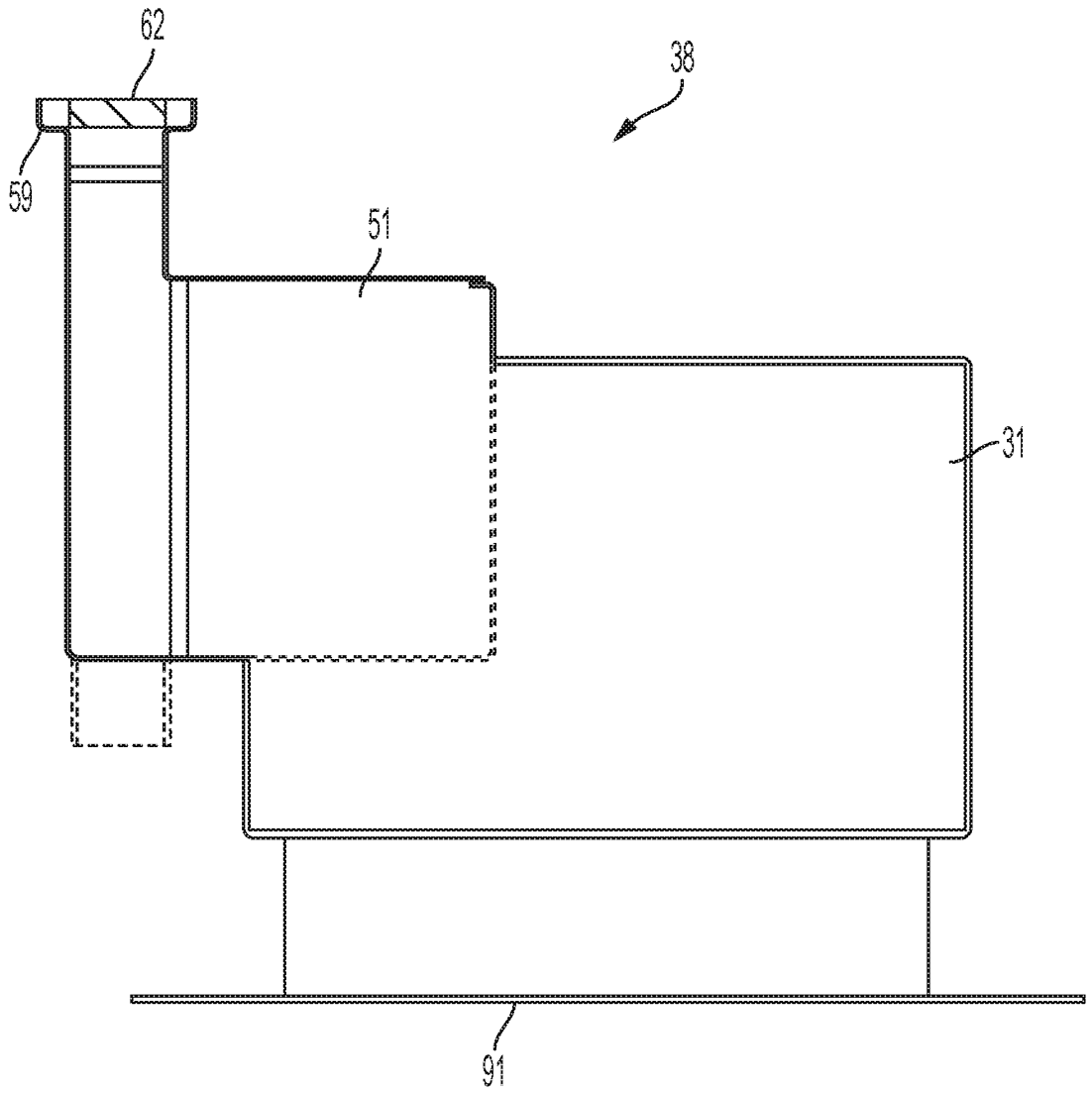
FIG. 13 is a cross section view of the air evacuation conduit of FIG. 11 connected to an evacuator drop out to an air exhaust system.

FIG. 9 illustrates that when the extra gutter trench conduit is used as a contaminated air evacuator conduit (38), a separate grate holder (59) may be configured to be flush with the above described deck drain grate (62) and receive an air evacuator port grate (not shown) therein. The air evacuator conduit (38) may connect to an evacuator plenum (51) that directs contaminated air through the plenum to an exhaust system (31) as shown in FIG. 13. The assembly of FIG. 9 may also include various support structures (71A, 71B) either on ends or entirely across the longitudinal axis of a conduit of the evacuator plenum (51).

Figure 10:
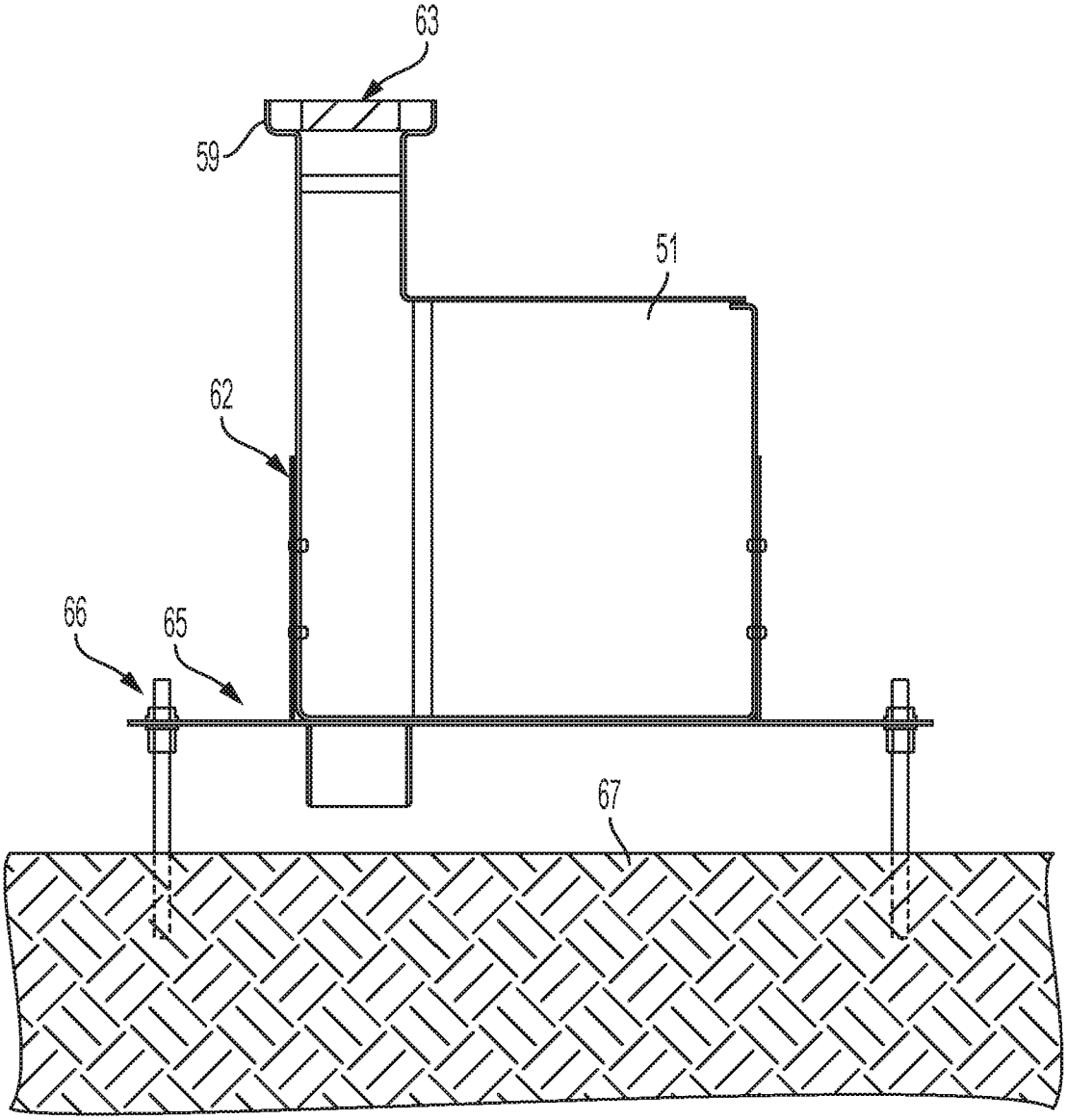
FIG. 10 is a cross section view of an air evacuation conduit positioned on a leveling plate and pool perimeter foundation as disclosed herein.

FIG. 10 shows the installation of FIG. 9 with the slotted evacuator grate (63) positioned therein, along with respective anchoring structures and couplings for installing the evacuator portion of the perimeter assembly.

Figure 11:
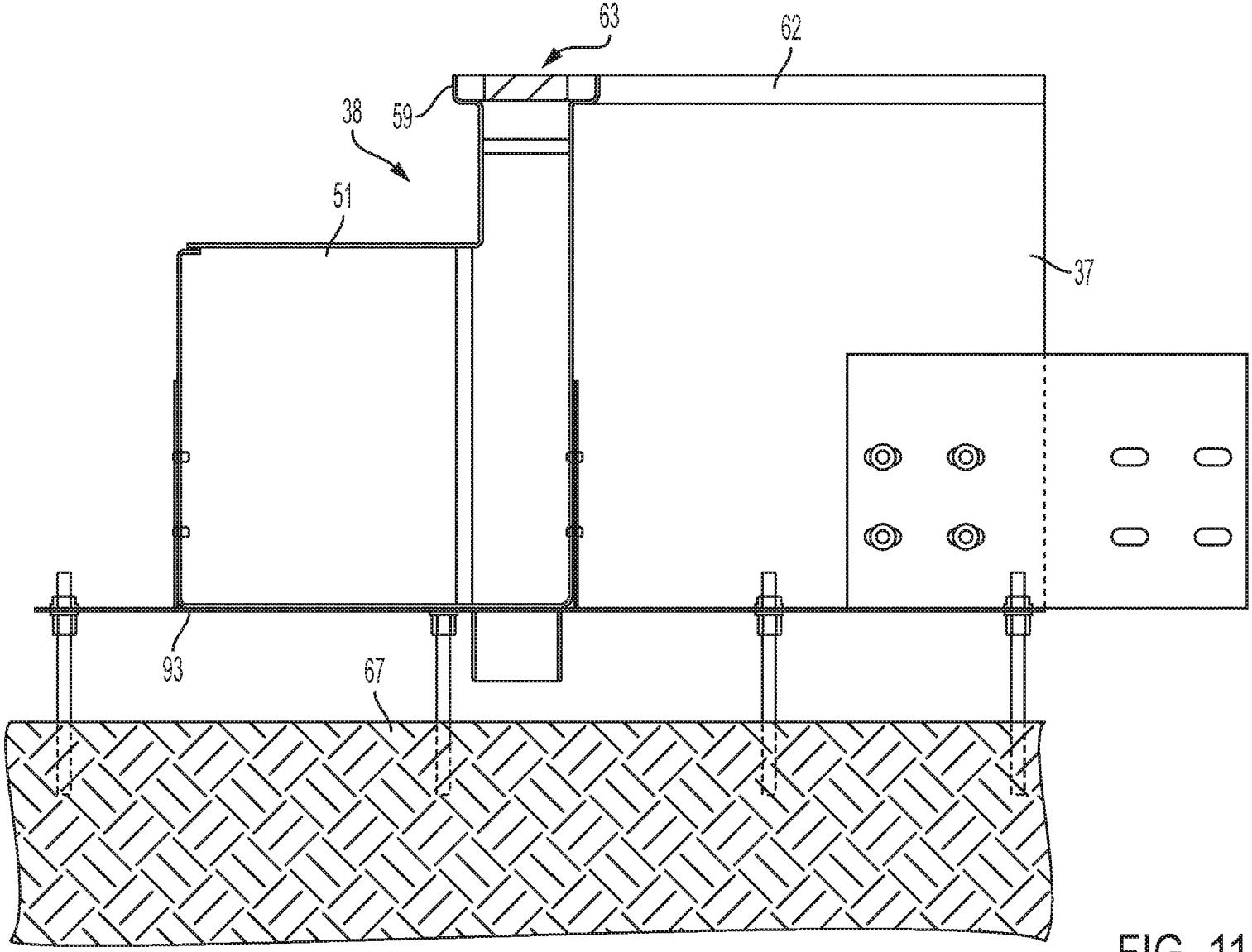
FIG. 11 is a cross section view of a pool perimeter assembly incorporating the air evacuation conduit of FIG. 9 and the gutter apparatus of FIG. 5 with both positioned on a leveling plate and perimeter foundation as disclosed herein.

FIG. 11 is directed to one embodiment of a corner assembly at which the air contaminant exhaust portion and extra gutter portion for excess water flow of a perimeter assembly (27) join at a corner of a pool.

Figure 12:
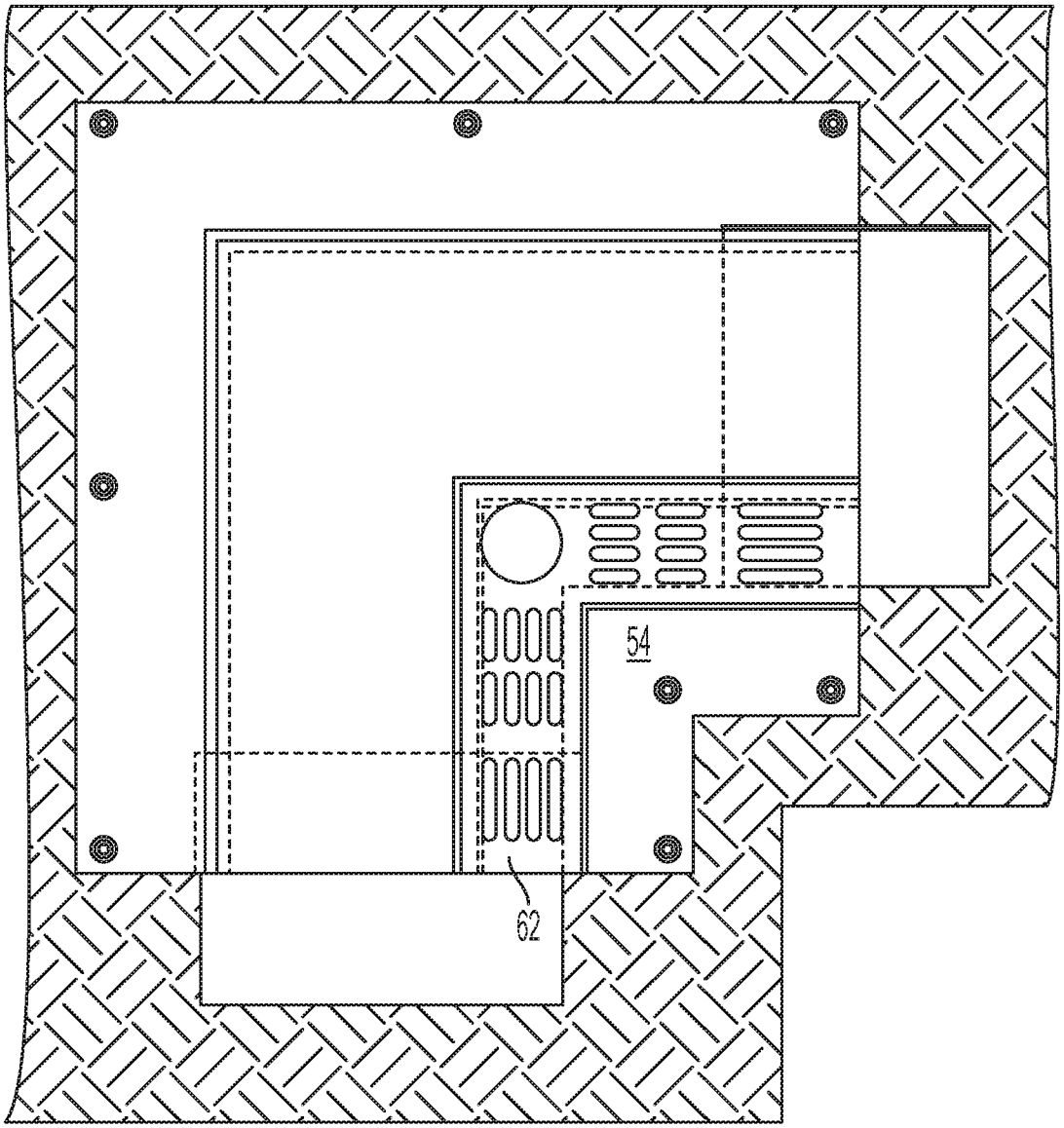
FIG. 12 is a top plan view of the perimeter assembly of FIG. 11 installed at a corner of a pool as disclosed herein.

FIG. 12 is a top view of the same embodiment of FIG. 11.

Figure 14:
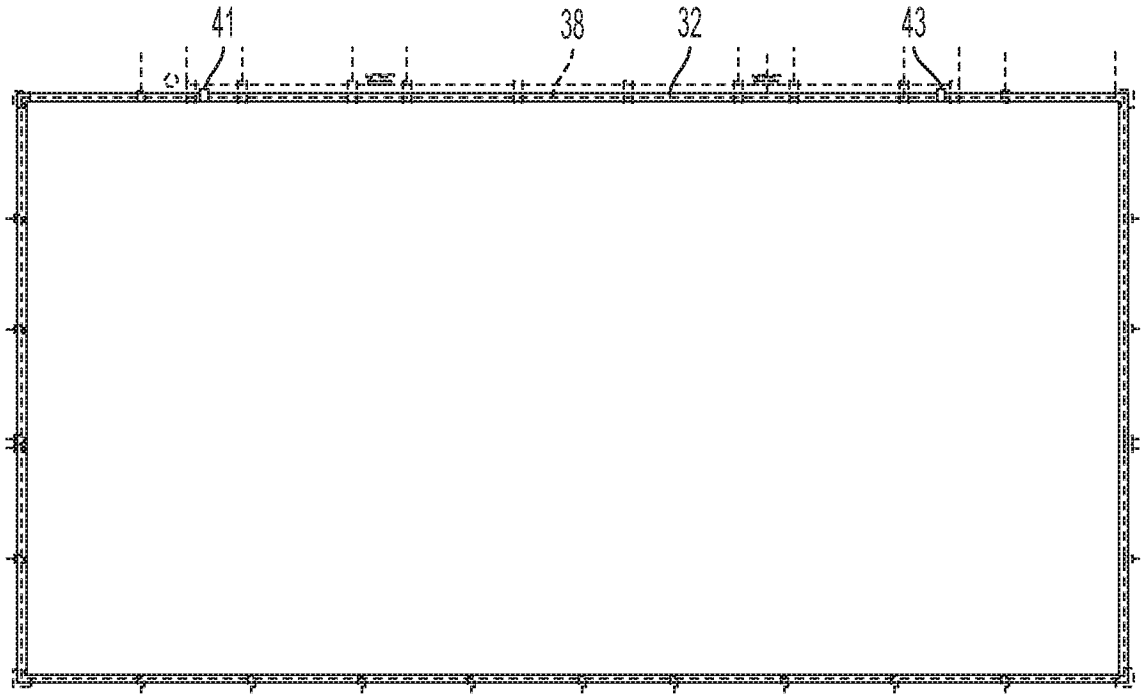
FIG. 14 is top plan view of a pool perimeter assembly of FIG. 11 installed about a pool on sides of the pool perimeter that are proximate to air handling return units in an enclosed structure surrounding the pool.
Figure 15A:
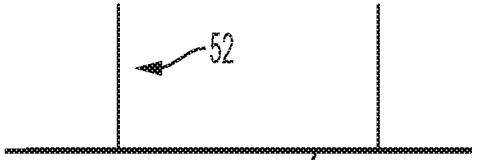
FIG. 15A is a schematic view of the air evacuator conduit of FIG. 9 in cross section with a leveling plate as described herein.
Figure 15B:
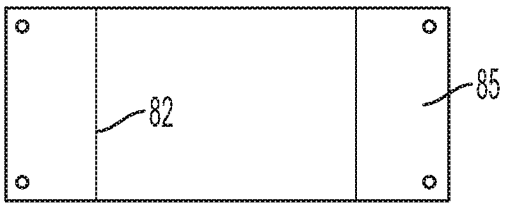
FIG. 15B is a schematic view of the air evacuator conduit of FIG. 9 in cross section with a leveling plate and coupling assembly as described herein.
Figure 15C:
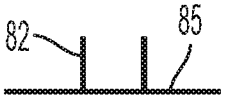
FIG. 15C is a schematic side view of the air evacuator conduit of FIG. 9 in cross section with a leveling plate as described herein.
Figure 15D:
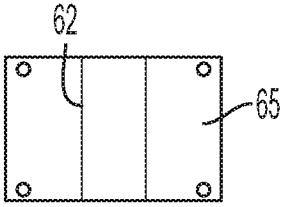
FIG. 15D is a top schematic view of the air evacuator conduit of FIG. 9 in cross section with a leveling plate as described herein.
Figure 15E:
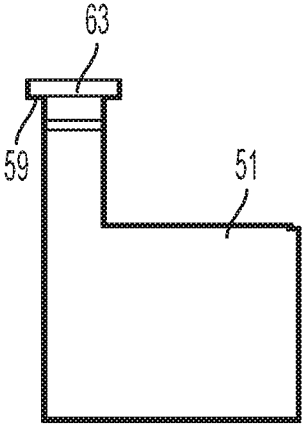
FIG. 15E is a side schematic view of the air evacuator conduit of FIG. 9 in cross section as described herein.
Figure 15F:
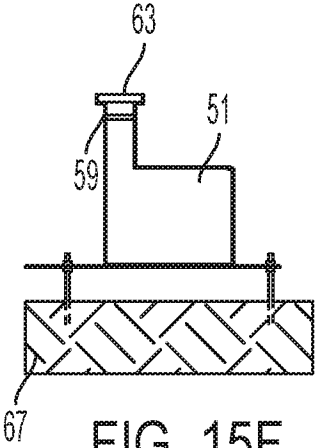
FIG. 15F is a side schematic view of the air evacuator conduit of FIG. 9 in cross section with a leveling plate as described herein.
Figure 15G:
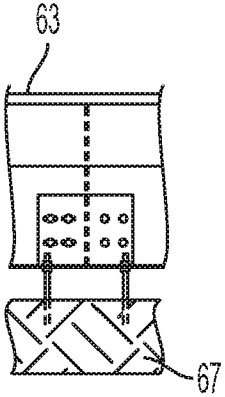
FIG. 15G is a schematic view of the air evacuator conduit of FIG. 9 in cross sections with a leveling plate as described herein.
Figure 15H:
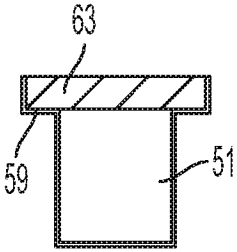
FIG. 15H is a schematic view of the air evacuator conduit of FIG. 9 in cross sections with a leveling plate as described herein.
Figure 15I:
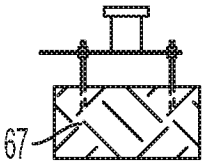
FIG. 15I is a schematic view of the air evacuator conduit of FIG. 9 in cross sections with a grate as described herein.
Figure 15J:
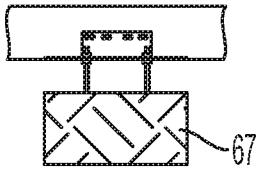
FIG. 15J is a schematic view of the air evacuator conduit of FIG. 9 in cross sections with a grate as described herein.

FIG. 14 represents one example configuration of the system described herein with details for parts and placement of parts. In one embodiment, these parts include the leveling plates (93) as part of the construction of the perimeter assembly (27) and/or the multi-conduit gutter trough assembly (33). Numbers of components used in FIGS. 15A-15J correspond to the same components described above.

In a first embodiment set for the herein, an apparatus for directing fluid flow around a pool includes a pool perimeter assembly defining at least two conduits extending between a first sidewall and a second sidewall, wherein the conduits are separated by a common wall between the first sidewall and the second sidewall. A grate is positioned on the pool perimeter assembly in a position to direct fluid flow into at least one of the conduits, and the grate defines a hand hold section that drains into one of the conduits. The grate defines the hand hold section as an indention or recess extending from an uppermost surface of the grate toward the pool perimeter assembly in a direction configured to drain the hand hold section into the pool perimeter assembly. The grate defines at least one opening extending from the uppermost surface of the grate to the pool perimeter assembly. The opening may be elongated. The grate defines a plurality of openings that are positioned in the grate in groups such that within a respective group, the openings are parallel. The respective groups of openings extend along the grate such that a number of openings are parallel to each other and a number of openings are perpendicular to each other. The grate further comprises a gutter trough entry section and an air evacuator conduit entry section.

The two conduits comprise a gutter trough conduit and an extra gutter conduit and the common wall defines a common opening between the two conduits. The gutter apparatus is configured to receive water from the pool though the grate, and wherein the pool perimeter assembly is further configured such that filling the gutter trough to the common opening allows for an overflow of water into the extra gutter conduit. The two conduits therefore have a gutter trough conduit and an air evacuator conduit. The gutter trough entry section is configured to receive water from the pool and the air evacuator conduit entry section is configured to receive air flow from areas around the pool. The gutter trough entry section is connected to a drain extending from one of the conduits to a water filtering system. The evacuator conduit entry section is connected to an air exhaust system via one of the conduits.

The pool perimeter assembly is positioned along the pool perimeter proximate a water return conduit extending from a water filtering system and dispersing filtered water into the pool. The conduit is positioned between a pool wall and the gutter apparatus.

In another embodiment, an apparatus directs air including water vapor and contaminants to an exhaust conduit from an area above a pool enclosing a body of liquid. The pool is adjacent to and surrounded by a grating system that is positioned between a deck and the pool. This apparatus includes a first sidewall and an opposite second sidewall both connected to a bottom wall to define a gutter apparatus conduit collecting and directing fluid flow received from the body of liquid through the grating system. The first sidewall is connected to the pool. A common wall is between the first sidewall and the second sidewall such that the first sidewall, the second side wall, and common wall define first and second conduits extending between the first sidewall and the second sidewall. One of the conduits directs air in a fluid flow to an exhaust system, and, said one of the conduits is in a position that avoids collecting liquids received through the grating system. The conduits define respective ports between the pool and the deck.

In another embodiment, at least two conduits extend between a first sidewall and a second sidewall, and the conduits are separated by a common wall between the first sidewall and the second sidewall. A grate is positioned on the conduits in a position to direct fluid flow into at least one of the conduits, wherein a first length of the perimeter assembly comprises the two conduits defining a gutter trough conduit and an extra gutter conduit separated in part by the common wall, wherein the common wall defines a common opening between the gutter trough conduit and the extra gutter conduit, and wherein a second length of the perimeter assembly comprises the two conduits defining a gutter trough conduit and an evacuator conduit separated by a section of the common wall without the common opening.

The first length of the assembly and the second length of the assembly are connected at at least one connection point along the pool perimeter. The at least one connection point connects the first length and the second length to close at least one end of at least one of the first length and the second length so that fluid flow is restricted between the first length of the perimeter assembly and the second length of the perimeter assembly. The first length of the assembly extends around a first portion of the pool perimeter and the second length of the assembly extends between respective ends of the first length. The position of the first length and the position of the second length along the pool perimeter are configured to maximize air flow into the evacuator conduit relative to an external heating ventilation and cooling system. The second length along the pool perimeter is positioned proximate return ports for the external heating ventilation and cooling system. The pool perimeter has defined regions of equal length, and a majority of the regions comprise the two conduits configured to match the first length of the assembly and the remaining regions comprise the two conduits configured to match the second length of the assembly. The grate defines at least one ventilation opening extending from the uppermost surface of the grate to the evacuator conduit for air flow therein, wherein the at least one ventilation opening has a size determined by exhaust air handling parameters of an exhaust system connected to the evacuator conduit. The grate is connected to the sidewalls and the conduits by a cam lock that secures the grate to the pool perimeter. At least a portion of the pool perimeter assembly is positioned between a pool wall and a pool deck at an upward incline from the pool wall.

In another embodiment, a system of managing fluid flow through a pool perimeter assembly includes directing ambient air flow from an air handling source across the surface of a pool of liquid and moving pool surface air flow. The system evacuates the pool surface air flow into at least one port defined by the pool perimeter assembly conduit and into an exhaust system. By positioning the at least one port to move the pool surface air into an evacuation conduit, the evacuation conduit is integrated into a gutter apparatus defining at least two conduits extending between a first sidewall and a second sidewall, wherein the conduits are separated by a common wall between the first sidewall and the second sidewall. A first length of the perimeter assembly comprises the two conduits defining a gutter trough conduit and an extra gutter conduit separated in part by the common wall, wherein the common wall defines a common opening between the gutter trough conduit and the extra gutter conduit. A second length of the assembly has the two conduits defining a gutter trough conduit and the evacuator conduit separated by a section of the common wall without the common opening.

In yet another embodiment, a pool perimeter assembly includes a flow apparatus defining at least two conduits extending between a first sidewall and a second sidewall, wherein the conduits are separated by a common wall between the first sidewall and the second sidewall. A grate is positioned on the flow apparatus in a position to direct fluid flow into at least one of the conduits. A leveling plate connects the pool perimeter assembly to a foundation defining a horizontal support. A first length of the perimeter assembly has the two conduits defining a gutter trough conduit and an extra gutter conduit separated in part by the common wall, wherein the common wall defines a common opening between the gutter trough conduit and the extra gutter conduit. A second length of the assembly comprises the two conduits defining a gutter trough conduit and an evacuator conduit separated by a section of the common wall without the common opening. The gutter trough is inclined upward relative to the horizontal support.

The above noted disclosure is set forth further in the claims that follow.

The invention claimed is:

1. A pool perimeter assembly comprising:

at least two conduits extending between a first sidewall and a second sidewall, wherein the conduits are separated by a common wall between the first sidewall and the second sidewall;

a grate positioned on the conduits in a position to direct fluid flow into at least one of the conduits, wherein a first length of the perimeter assembly comprises the two conduits defining a gutter trough conduit and an extra gutter conduit separated in part by the common wall, wherein the common wall defines a common opening between the gutter trough conduit and the extra gutter conduit, and wherein a second length of the perimeter assembly comprises the two conduits defining a gutter trough conduit and an evacuator conduit separated by a section of the common wall without the common opening.

2. A pool perimeter assembly according to claim 1, wherein the first length of the assembly and the second length of the assembly are connected at least one connection point along the pool perimeter.

3. A pool perimeter assembly according to claim 2, wherein the at least one connection point connecting the first length and the second length are configured to close at least one end of at least one of the first length and the second length so that fluid flow is restricted between the first length of the perimeter assembly and the second length of the perimeter assembly.

4. A pool perimeter assembly according to claim 2, wherein the first length of the assembly extends around a first portion of the pool perimeter and the second length of the assembly extends between respective ends of the first length.

5. A pool perimeter assembly according to claim 4, wherein the position of the first length and the position of the second length along the pool perimeter are configured to maximize air flow into the evacuator conduit relative to an external heating ventilation and cooling system.

6. A pool perimeter assembly according to claim 5, wherein the second length along the pool perimeter is positioned proximate return ports for the external heating ventilation and cooling system.

7. A pool perimeter assembly according to claim 1, wherein the pool perimeter has defined regions of equal length, and a majority of the regions comprise the two conduits configured to match the first length of the assembly and the remaining regions comprise the two conduits configured to match the second length of the assembly.

8. A pool perimeter assembly according to claim 1, wherein the grate defines at least one ventilation opening extending from the uppermost surface of the grate to the evacuator conduit for air flow therein, wherein the at least one ventilation opening has a size determined by exhaust air handling parameters of an exhaust system connected to the evacuator conduit.

9. A pool perimeter assembly according to claim 1, wherein the grate is connected to the sidewalls and the conduits by a cam lock that secures the grate to the pool perimeter.

10. A pool perimeter assembly according to claim 1, wherein at least a portion of the pool perimeter assembly is positioned between a pool wall and a pool deck at an upward incline from the pool wall.

11. A system of managing fluid flow through a pool perimeter assembly, comprising: directing ambient air flow from an air handling source across the surface of a pool of liquid and moving pool surface air flow;

evacuating the pool surface air flow into at least one port defined by the pool perimeter assembly conduit and into an exhaust system;

positioning the at least one port to move the pool surface air into an evacuation conduit; wherein the evacuation conduit is integrated into a gutter apparatus defining at least two conduits extending between a first sidewall and a second sidewall, wherein the conduits are separated by a common wall between the first sidewall and the second sidewall;

wherein a first length of the perimeter assembly comprises the two conduits defining a gutter trough conduit and an extra gutter conduit separated in part by the common wall, wherein the common wall defines a common opening between the gutter trough conduit and the extra gutter conduit, and wherein a second length of the assembly comprises the two conduits defining a gutter trough conduit and the evacuator conduit separated by a section of the common wall without the common opening.

12. A pool perimeter assembly comprising:

a flow apparatus defining at least two conduits extending between a first sidewall and a second sidewall, wherein the conduits are separated by a common wall between the first sidewall and the second sidewall;

a grate positioned on the flow apparatus in a position to direct fluid flow into at least one of the conduits, a leveling plate connecting the pool perimeter assembly to a foundation defining a horizontal support;

wherein a first length of the perimeter assembly comprises the two conduits defining a gutter trough conduit and an extra gutter conduit separated in part by the common wall, wherein the common wall defines a common opening between the gutter trough conduit and the extra gutter conduit, and wherein a second length of the assembly comprises the two conduits defining a gutter trough conduit and an evacuator conduit separated by a section of the common wall without the common opening;

wherein the gutter trough is inclined upward relative to the horizontal support.

* * * * *